US006637688B1

(12) United States Patent
Nelson

(10) Patent No.: US 6,637,688 B1
(45) Date of Patent: Oct. 28, 2003

(54) WIRE ROLL DISPENSER APPARATUS

(76) Inventor: Michael Nelson, 6805 Garden Hwy., Sacramento, CA (US) 95837

( * ) Notice: Subject to any disclaimer, the term of this patent is extended or adjusted under 35 U.S.C. 154(b) by 0 days.

(21) Appl. No.: 10/057,416

(22) Filed: Jan. 25, 2002

(51) Int. Cl.[7] ..... B65H 49/30
(52) U.S. Cl. ..... 242/127
(58) Field of Search ..... 242/129, 127, 242/577.2, 577.3, 593, 595

(56) References Cited

U.S. PATENT DOCUMENTS 1,539,016 A 5/1925 Mizuno
1,706,605 A 3/1929 Haase
2,019,857 A 11/1935 Hoover
3,556,431 A 1/1971 Frietag
3,868,070 A 2/1975 Goodzey et al.
4,666,102 A 5/1987 Colbaugh et al.
4,811,918 A 3/1989 Grooms

*Primary Examiner*—Emmanuel Marcelo
(74) *Attorney, Agent, or Firm*—Theodore J. Bielen, Jr.

(57) ABSTRACT

A wire roll dispenser apparatus utilizing a base member having a surface contacting foundation. The base member also includes a platform element which extends outwardly from the foundation member. A plate of a certain in mass and engages a plurality of projections which span the plate and the surface element. The plate and surface element form space for a wire roll which is unrolled for use.

13 Claims, 3 Drawing Sheets

WIRE ROLL DISPENSER APPARATUS

BACKGROUND OF THE INVENTION

The present invention relates to a novel and useful wire roll dispensing apparatus.

Rolls of material such as wire or fencing mesh are often wound into layers of spiral configuration. Since the winding is often achieved through a machine, a considerable degree of compression is applied to the spirally wound roll. To maintain such compression during shipping, securing wires, ropes, lines, and the like are temporarily tied around the roll. When the securing line is severed, the roll has a tendency to expand and unravel uncontrollably. Dispensing of the wire or wire mesh is not easily achieved requiring multiple persons to orient and turn the roll.

In the past, systems have been devised to handle coils and rolls of material. For example, U.S. Pat. Nos. 1,539,016, 1,706,605, 2,019,857, and 3,556,431 show reels which rotate about a central axis to unwind material which is wrapped around the reel.

U.S. Pat. No. 4,811,918 teaches a roller which unwinds a web material through a roll friction bar. The bar maintains a constant tension on the screen material across the width of the screen roll.

U.S. Pat. 3,868,070 and 4,666,102 describe coil and cable dispensing apparatuses in which the wound material is held on a rotatable spindle and allowed to dispense or pay out from the reel. During the pay-out plates hold tension on the reel throughout its turning motion.

A wire roll dispensing apparatus which does not require a reel for use would be a notable advance in mechanical arts.

SUMMARY OF THE INVENTION

In accordance with the present invention a novel and useful apparatus for dispensing wire rolls is herein provided.

The dispenser of the present invention utilizes a base member which includes a foundation for contacting a surface and for supporting a platform element in an upright position. The platform element is rotatably mounted to the foundation member. In certain cases, the platform element make take the form of a plurality of arms and each having an upper surface for supporting wire roll. The arms may be adjustable to accommodate rolls of varying sizes and configurations.

A plurality of projections extend relative to the platform element. Such projections may be constructed in the forms of tubes that fit over bosses or protuberances located on any one of the plurality of arms. The projections may be removably held to the arms and are of a predetermined length to accommodate a roll of wire material without interfering with the same.

A plate of a pre-determined mass is also employed in the present invention. The plate is configured to engage the plurality of projections extending relative to the platform element. The plate and platform element form a space for accommodating the wire roll. That it is to say, the wire roll lies between the pressing plate and the platform element when being dispensed in the present invention. The plate may be formed with a number of recesses to positively engage the ends of the plurality of projections extending form the platform element. Such recesses may be patterned to engage the plurality of projections when the arms of the platform elements are extended or retracted as the case may be. Once the wire roll is placed beneath the weight of the plate and above the platform element it may dispensed easily such that the weight of the plate counter acts the expanding tendency of the roll. The base member also constructed such that the platform element is rotatably mounted with respect to the foundation member to allow the user to easily direct the paying-out of the wire roll when it is being employed in a construction or repair project.

It may be apparent that novel and useful surface supported wire roll dispenser apparatus has been herein above described.

Is therefor an object of the present invention to provide an apparatus for dispensing wire-like material which is simple to operate and requires a minimum of moving parts.

Another object of the present invention is to provide a wire roll dispenser apparatus which mounts on a surface and is capable of permitting the user to unwind or pay-out wire-like material in any direction about a central axis.

Another object of the present invention is to provide a wire roll dispenser apparatus which eliminates the need for a reel to dispense wire material.

A further object of the present invention is to provide a wire roll dispenser apparatus which greatly increases the safety of the workers who are unwinding a roll for use.

Yet another object of the present invention is to provide a wire roll dispenser which includes a minimum number of parts and is easily maintained and repaired.

Another object for the present invention is to provide a wire roll dispenser apparatus which is capable paying out wire-like material and possesses versatility in accommodating wire rolls of varying sizes.

The invention possesses other objects and advantages especially of concerns particular characteristics and features thereof which will become apparent as the specification continues.

For a better understanding of the invention references made to the following detailed description of the preferred embodiments thereof which should be taken in conjunction with the herein above described drawings.

DETAILED DESCRIPTION OF THE PREFERRED EMBODIMENTS

Various aspects of the present invention will evolve from the following detailed description of the preferred embodiments thereof which should be referenced to the prior delineated drawings.

Figure 1:
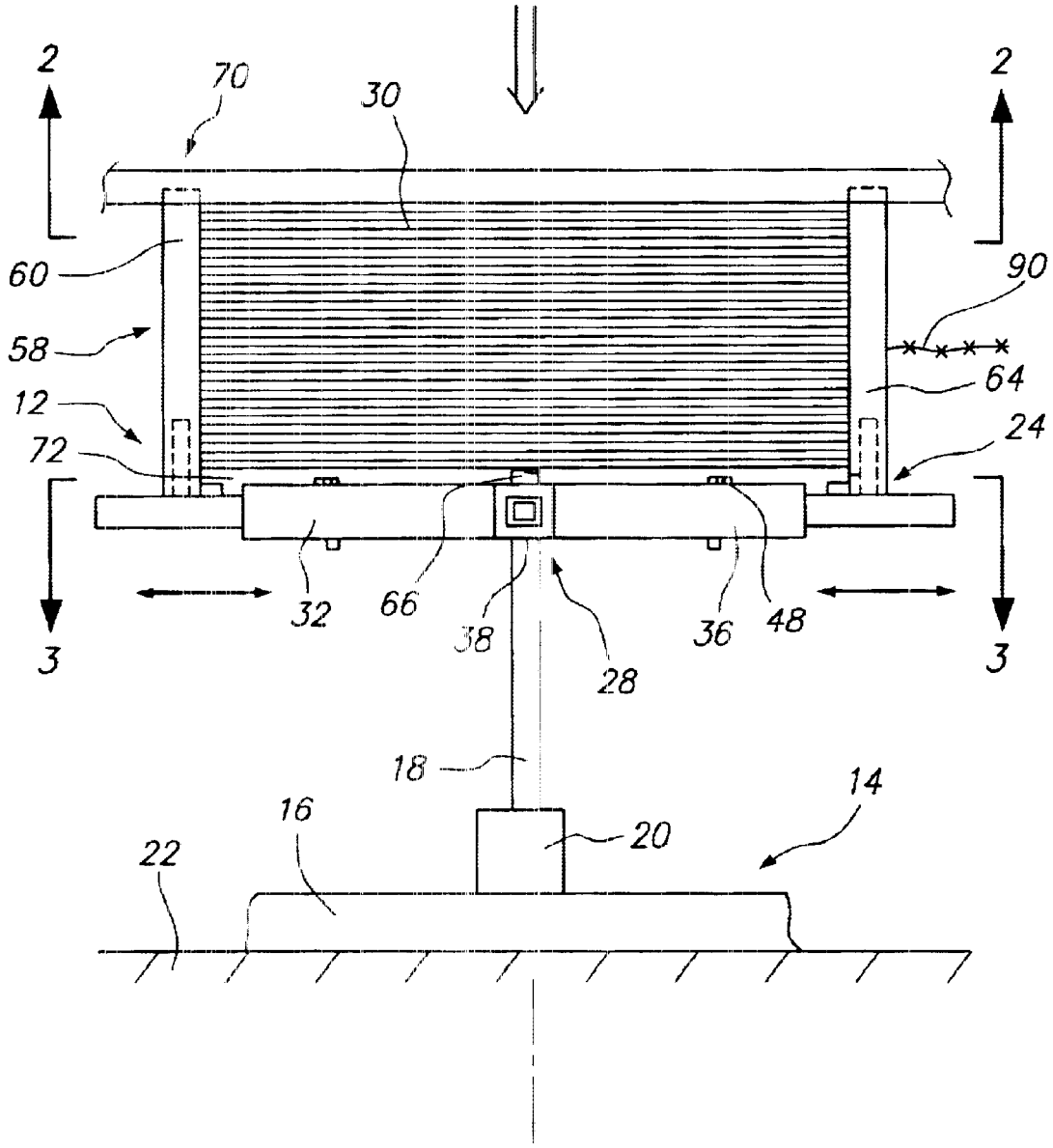
FIG. 1 is a front elevational view of the apparatus of the present invention.

The embodiment of the invention is shown in the drawings in whole by reference character 10. Apparatus 10 includes as one of its elements base member 12. Base member 12 possesses a foundation element 14 having a foot 16 and a post 18 held by hollow support 20. Foot 16 rests on ground surface 22 and supports post 18 in an upright position, as depicted in FIG. 1.

Figure 2:
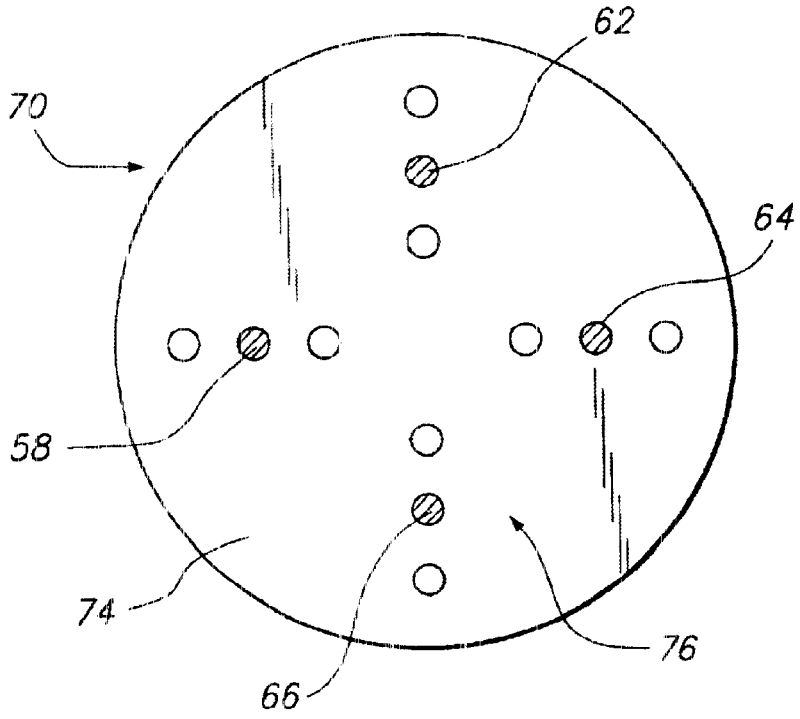
FIG. 2 is a sectional view taken along line 2—2 of FIG. 1.
Figure 3:
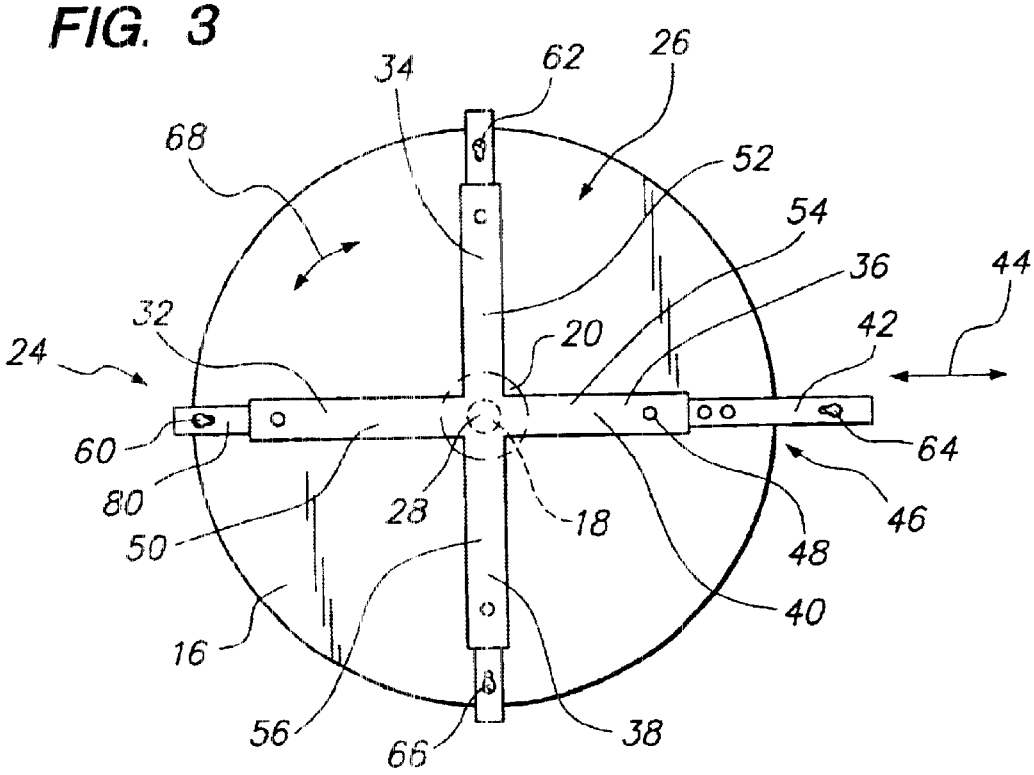
FIG. 3 is a sectional view taken along line 3—3 of FIG. 1.

Base 12 also includes a platform element 24. Platform element 24, FIGS. 1 and 3 may take the form of a plurality of arms 26 which extend outwardly from a central hub or socket 28. Each arm includes an upper surface which lies generally at the same height and provide a platform for wire roll 30. That is to say, the embodiment described in the drawing shows arms 32, 34, 36, and 38. Each of the arms 32, 34, 36 and 38 is formed into two parts. With reference to exemplary arm 36, it may be seen that a hollow first portion 40 accommodates a movable second portion 42, directional arrow 44. A multiplicity of openings 46 through second portion 44 accommodate elongated fastener such as bolt 48 to fix the overall length of arm 36 relative to hub 28. It should be understood that arms 32, 34, and 38 are likewise adjustable. Platform element 24 provides a platform for a roll 30 by contact of the upper surfaces 50, 52, 54, and 56 of arms 32, 34, 36, and 38, respectively. In certain embodiments, platform element 24 may include a solid uninterrupted surface in this regard. Platform element 24 is rotatably mounted with respect to post 18. That is to say, hub 28 rotates relative to post 18 according to direction al arrow 68, FIG. 3 Returning to FIG. 1, it may observed that a plurality of projections 58 extend outwardly relative to platform element 24. For example, projections 60, 62, 64 and 66 (truncated) are depicted in FIGS. 1–3. Projections 60,62, 64, and 66 are associated with arms 32, 34, 36 and 38 respectively. Projections 60, 62, 64 and 66 serve to control the expansion of roll 30.

A plate 70, FIG. 2, is also employed in apparatus 10. Plate 70 is constructed of a certain weight to press on wire roll 30 in the space 72 created between plate 70 and platform element 24. In this regard, lower surface 74 of plate 70 includes plurality of recesses 76. Such plurality of recesses 76 are aligned to encompass any of the plurality of projections 58, 60, 62, and 64, commensurate with the length adjustment of arms 32, 34, 36, and 38.

Figure 4:
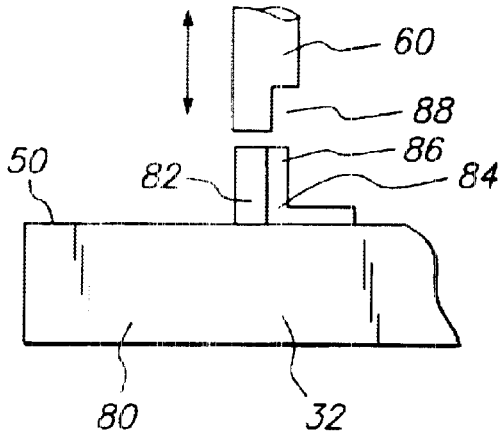
FIG. 4 is a side elevational view of a partial single arm of the platform element showing the engagement of a projection thereto.
Figure 5:
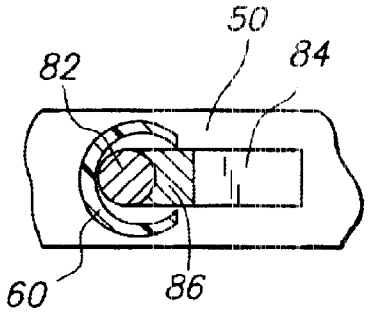
FIG. 5 is a sectional view of an arm of the present invention in which a projection has been in place there upon.

With reference to FIG. 4, it may be seen that arm 32 is depicted with respect to fixed second portion 80 thereof. A boss 82 is welded or otherwise fixed to surface 50 and includes an L-shaped spacer 84 which lies against boss 82. Projection 60, in the form of a tube, includes a cutout lower portion 88 which fits adjacent upper portion 86 of L-shaped spacer 80. Thus, projection 60, when fitting over boss 82 and L-shape spacer 84, does not rotate, FIG. 5.

Figure 6:
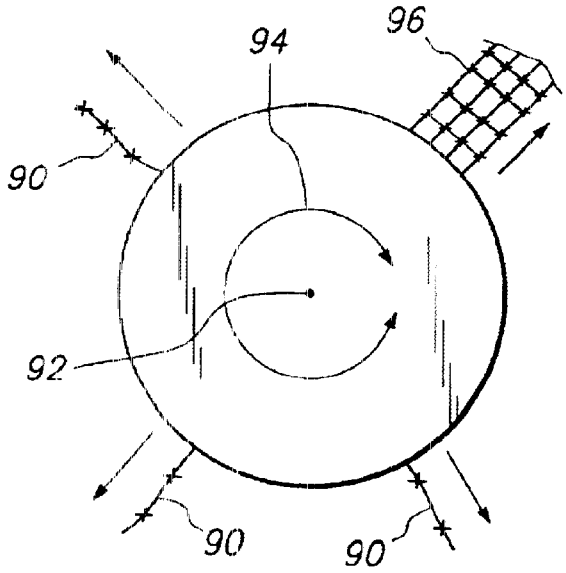
FIG. 6 is a top plan view of the apparatus of the present invention indicating rotation of the platform element and plate to allow dispensing of wire-like material in various directions.

In operation, the user places roll 30 in space 72 between plate 70 and platform element 24. Wire roll 30 is pressed downwardly by the weight of plate 70 which maintains compression of the coil roll 30. Projections 60, 62, 64 and 66 confine roll 30 laterally within space 72. Roll 30 may be barbed wire, as shown in FIG. 6. The end 90 of roll 30 may be a singly strand or a mesh or matrix, is then pulled outwardly from space 72 for use. Wire roll 30 turns within space 72 in a controlled manner. A rotation of platform elements 24 and plate 70 permits the user to orient or direct the paying out of end 90 of roll 30 in multiple directions. FIG. 6 indicates the rotation of plate 70 and platform element 24 about axis 92 according to directional arrow 94. End 90, in form a single strand is depicted in multiple directions while a matrix, such as a fencing type material 96, is also depicted as being unraveled from roll 30.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A surface supported wire roll dispenser apparatus, comprising;

a. a base member, said base member including a foundation member for contacting a surface and platform element mounted to said foundation member;

b. a plurality of projections extending relative to said platform element; and c. a plate of predetermined mass engaging said plurality of projections and the wire roll, said wire roll located in a space for accommodating the wire roll between said plate and said platform element, and means for rotatably mounting said platform to said foundation member, said means for rotatably mounting said platform to said foundation member further comprising a socket extending from said foundation member and a post formed on said platform element, said post being rotatably held within said socket.

2. The apparatus of claim 1 in which at least one of said plurality of projections extending relative to said platform element further includes means for holding said at least one projection to said platform element.

3. The apparatus of claim 2 in which said at least one projection further comprises means for removably holding said at least one projection to said platform element.

4. The apparatus of claim 3 in which said means for removably holding said at least one projection further comprises a boss fixed to said platform element and a hollow tube at least partially encompassing said boss, said hollow tube being removably held to said boss.

5. A surface supported wire roll dispenser apparatus, comprising;

a. a base member, said base member including a foundation member for contacting a surface and a platform element mounted to said foundation member; said platform element comprising a plurality of arms oriented outwardly from a hub, each of said arms including a surface for contacting the wire roll;

b. a plurality of projections extending relative to said platform element; and c. a plate of predetermined mass engaging said plurality of projections and the wire roll, said wire roll located in a space for accommodating the wire roll between said plate and said platform element.

6. The apparatus of claim 5 in which at least one of said plurality of arms includes a first portion and a second portion removably held relative to said first portion to determine a dimension of elongation of said at least one of said plurality of arms.

7. The apparatus of claim 6 which additionally comprises means for rotatably mounting said platform to said foundation member.

8. The apparatus of claim 6 in which at least one of said plurality of projections extending relative to said platform element further includes means for holding said at least one projection to said platform element.

9. The apparatus of claim 6 in which said at least one projection further comprises means for removably holding said at least one projection to said platform element.

10. The apparatus of claim 9 in which said plate includes a multiplicity of recesses, said hollow tube fitting in any of said multiplicity of recesses.

11. The apparatus of claim 5 which additionally comprises means for rotatably mounting said platform to said foundation member.

12. The apparatus of claim 5 in which at least one of said plurality of projections extending relative to said platform element further includes means for holding said at least one projection to said platform element.

13. The apparatus of claim 5 in which said at least one projection further comprises means for removably holding said at least one projection to said platform element.

* * * * *